US009623675B2

(12) United States Patent
Hara

(10) Patent No.: US 9,623,675 B2
(45) Date of Patent: Apr. 18, 2017

(54) LIQUID DISCHARGING APPARATUS AND HEATING UNIT CONTROL METHOD

(71) Applicant: SEIKO EPSON CORPORATION, Tokyo (JP)

(72) Inventor: Osamu Hara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 18 days.

(21) Appl. No.: 14/730,416

(22) Filed: Jun. 4, 2015

(65) Prior Publication Data

US 2015/0352840 A1 Dec. 10, 2015

(30) Foreign Application Priority Data

Jun. 4, 2014 (JP) ..... 2014-115509

(51) Int. Cl.
*B41J 11/00* (2006.01)
*B41J 2/045* (2006.01)

(52) U.S. Cl.
CPC ..... *B41J 11/002* (2013.01); *B41J 2/04563* (2013.01); *B41J 2/04585* (2013.01)

(58) Field of Classification Search
CPC ..... B41J 2/04563
See application file for complete search history.

(56) References Cited

U.S. PATENT DOCUMENTS 4,602,642 A * 7/1986 O'Hara et al. ..... G01J 5/02 374/126
2007/0204961 A1* 9/2007 Nakashima et al. ..... 156/583.1
2007/0235437 A1* 10/2007 Klobucar ..... F26B 15/14 219/388
2013/0044153 A1* 2/2013 Sasaki et al. ..... 347/16

FOREIGN PATENT DOCUMENTS

JP 2005-201731 A 7/2005
JP 2009-251408 A 10/2009

* cited by examiner

*Primary Examiner* — Manish S Shah
*Assistant Examiner* — Jeffrey C Morgan
(74) *Attorney, Agent, or Firm* — Workman Nydegger

(57) ABSTRACT

A liquid discharging apparatus includes a discharge unit that is capable of discharging a liquid, a heating unit that is capable of heating a medium onto which the liquid is discharged, a detection unit that detects an energy that is emitted from a detection range, a control unit that is capable of changing an output of the heating unit on the basis of an energy that the detection unit detects, and a sensing target portion, which has a sensing target surface from which an energy is detected by the detection unit, and the sensing target surface is processed in order to reduce mirror reflection of input light.

8 Claims, 6 Drawing Sheets

FIG. 7

| | MATERIAL | RADIATION RATE |
|---|---|---|
| MEDIUM A | ACRYLIC RESIN | 0.8 |
| MEDIUM B | ACRYLIC RESIN | 0.83 |
| MEDIUM C | PET RESIN | 0.85 |
| MEDIUM D | PET RESIN | 0.87 |
| MEDIUM E | VINYL CHLORIDE RESIN | 0.9 |
| MEDIUM F | VINYL CHLORIDE RESIN | 0.9 |
| MEDIUM G | VINYL CHLORIDE RESIN | 0.91 |
| MEDIUM H | FABRIC | 0.92 |
| MEDIUM I | PAPER | 0.94 |
| MEDIUM J | FABRIC | 0.95 |
| MEDIUM K | PAPER | 0.95 |

LIQUID DISCHARGING APPARATUS AND HEATING UNIT CONTROL METHOD

BACKGROUND

1. Technical Field

The present invention relates to a liquid discharging apparatus and a heating unit control method.

2. Related Art

In the related art, an image forming apparatus is known, which is provided with a fixer that nip transports recording paper using a heating roller and a pressing roller, and fixes a transferred toner image onto the recording paper, a recording paper temperature sensor that detects a surface temperature of the recording paper immediately after passing through the fixer, a control unit that switches a setting temperature of the heating roller depending on the surface temperature of the recording paper that is detected by the recording paper temperature sensor, and the like (for example, refer to JP-A-2009-251408).

However, in the abovementioned apparatus, for example, there is a problem in that, in a case in which there is no recording paper in a location in which the recording paper temperature sensor detects temperature, it is not possible to detect the temperature of the recording paper, and therefore, it is not possible to suitably perform temperature control of the heating roller.

SUMMARY

The invention can be realized in the following forms or application examples.

Application Example 1

According to this application example, there is provided a liquid discharging apparatus including a discharge unit that is capable of discharging a liquid, a heating unit that is capable of heating a medium onto which the liquid is discharged, a detection unit that detects an energy that is emitted from a detection range, a control unit that is capable of changing an output of the heating unit on the basis of an energy that the detection unit detects, and a sensing target portion, which has a sensing target surface from which an energy is detected by the detection unit, in which the sensing target surface is processed in order to reduce mirror reflection of input light.

According to this configuration, it is possible to suitably perform output control of the heating unit even in a case in which a medium is not in a detection range of the detection unit. In addition, by detecting an energy that is reflected from the sensing target portion, a mirror reflection component of which has been reduced, with the detection unit, it is possible to perform output control of the heating unit with further precision.

Application Example 2

In the liquid discharging apparatus according to the application example, it is preferable that the sensing target surface is processed so as to have first portions, and second portions that are lower than the first portions.

According to this configuration, when light, which is input from the heating unit, is reflected by the sensing target surface, the light is dispersed (scattered) by the first portions and the second portions. Accordingly, the mirror reflection component can be reduced.

Application Example 3

In the liquid discharging apparatus according to the application example, it is preferable that surface processing is carried out on at least a portion of the sensing target surface.

According to this configuration, when light, which is input from the heating unit, is reflected by the sensing target surface, the light is dispersed (scattered) or absorbed due to the surface processing. Accordingly, the mirror reflection component can be reduced.

Application Example 4

In the liquid discharging apparatus according to the application example, it is preferable that at least a portion of the sensing target surface is made of an aluminum on which alumite processing has been performed.

According to this configuration, when light, which is input from the heating unit, is reflected by the sensing target surface, the light is dispersed or absorbed due to the alumite processing of the sensing target surface. Accordingly, the mirror reflection component can be reduced.

Application Example 5

In the liquid discharging apparatus according to the application example, it is preferable that a radiation rate of the sensing target portion is greater than or equal to 0.7 and less than 1.

According to this configuration, since a radiation rate of the sensing target portion is close to a radiation rate of a medium, it is possible to perform output control of the heating unit suitable for heating the medium even in a case in which an energy has been detected from the sensing target portion.

Application Example 6

In the liquid discharging apparatus according to the application example, it is preferable that the liquid discharging apparatus further include a support unit with a support surface that is capable of supporting the medium, and the sensing target portion is provided on the same surface as the support surface, or in a position that is lower than the support surface.

According to this configuration, since the sensing target portion is provided on the same surface as the support surface, or in a position that is lower than the support surface, it is possible to perform transport of a medium smoothly with the sensing target portion not obstructing transport of a medium.

Application Example 7

In the liquid discharging apparatus according to the application example, it is preferable that the detection unit detects an energy from the medium when the medium is in the detection region, and detects an energy from the sensing target portion when the medium is not in the detection region.

According to this configuration, it is possible to detect an energy suitably based on the presence or absence of a medium in the detection range.

Application Example 8

According to this application example, there is provided a heating unit control method including discharging a liquid, heating a medium onto which the liquid is discharged with a heating unit, detecting an energy that is emitted from the detection region, and changing an output of the heating unit on the basis of the detected energy, in which the energy is detected from a sensing target surface, which is processed in order to reduce mirror reflection of input light.

According to this configuration, it is possible to suitably perform output control of the heating unit even in a case in which a medium is not in a detection range. In addition, by detecting an energy that is reflected from the sensing target portion, a mirror reflection component of which has been reduced, with the detection unit, it is possible to perform output control of the heating unit with further precision.

BRIEF DESCRIPTION OF THE DRAWINGS

The invention will be described with reference to the accompanying diagrams, wherein like numbers reference like elements.

FIG. 7 is an explanatory diagram that shows the radiation rates of various media.

DESCRIPTION OF EXEMPLARY EMBODIMENTS

Hereinafter, embodiments of the invention will be described with reference to the drawings. Additionally, in each of the drawings, components are shown with the scales altered from practical scales for recognizing each component.

Firstly, a configuration of the liquid discharging apparatus will be described. The liquid discharging apparatus is provided with a discharge unit that is capable of discharging a liquid, a heating unit that is capable of heating a medium onto which the liquid is discharged, a detection unit that detects an energy that is emitted from a detection range, a control unit that is capable of changing an output of the heating unit on the basis of an energy that the detection unit detects, and a sensing target portion, which has a sensing target surface from which an energy is detected by the detection unit, and the sensing target surface is processed in order to reduce mirror reflection of input light. In addition, a heating unit control method includes discharging a liquid, heating a medium onto which the liquid is discharged, detecting an energy that is emitted from the detection range, and changing an output of the heating unit on the basis of the detected energy, and the energy is detected from a sensing target surface, which is processed in order to reduce mirror reflection of input light. For example, it is possible to adopt an ink jet printer as the liquid discharging apparatus. The liquid discharging apparatus will be described more specifically below.

Figure 1:
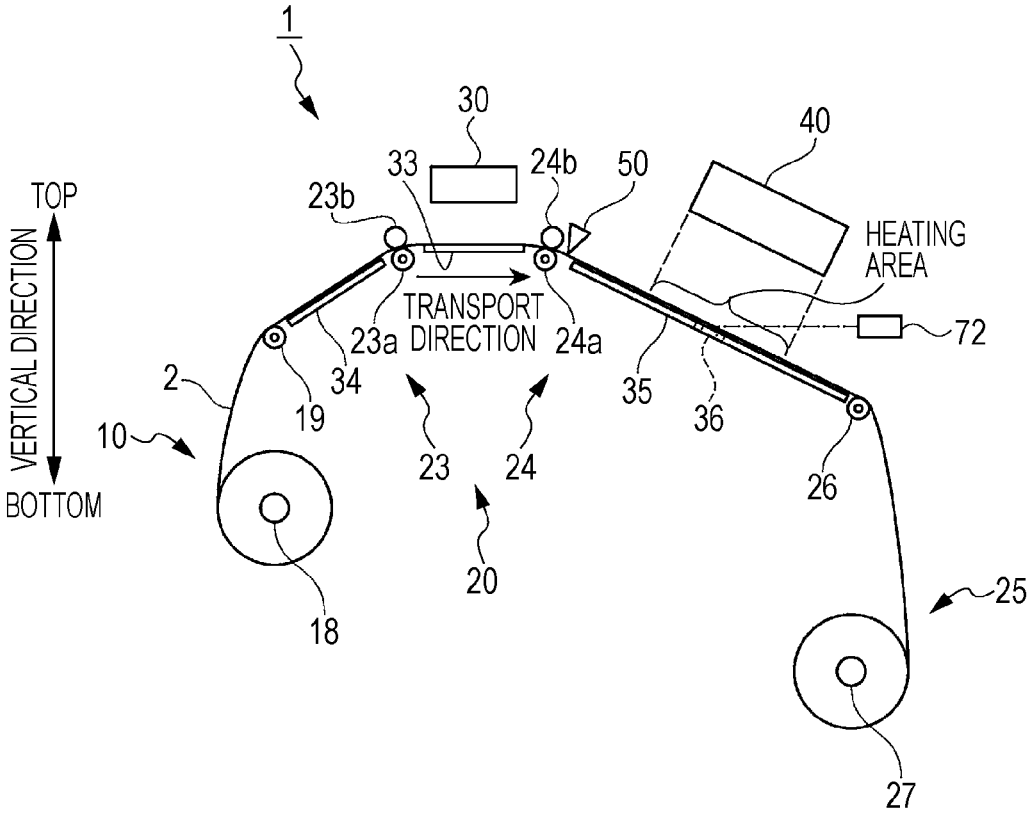
FIG. 1 is a schematic diagram that shows a configuration of a liquid discharging apparatus.

FIG. 1 is a schematic diagram that shows a configuration of a liquid discharging apparatus. As shown in FIG. 1, a liquid discharging apparatus 1 includes a feeding unit 10, a transport unit 20, a winding unit 25, a discharge unit 30, a support portion 35, a sensing target portion 36, a heating unit 40, a cutter 50 and a detection unit 72. Further, the liquid discharging apparatus 1 is provided with a control unit 60 (refer to FIG. 2) that controls the abovementioned members.

The feeding unit 10 is a unit that feeds a roll-shaped medium 2, as an example of a medium, to the transport unit 20. As shown in FIG. 1, the feeding unit 10 includes a roll-shaped medium winding shaft 18 on which the roll-shaped medium 2 is wound and rotatably supported, and a relay roller 19 for guiding the roll-shaped medium 2, which is sent out from the medium winding shaft 18, to the transport unit 20 with the roll-shaped medium 2 suspended on the relay roller 19.

The transport unit 20 is a unit that transports the roll-shaped medium 2, which is delivered by the feeding unit 10, in a transport direction along a transport pathway that is set in advance. As shown in FIG. 1, the transport unit 20 includes a first transport roller 23 and a second transport roller 24 that is positioned on a downstream side of the first transport roller 23 in the transport direction. The first transport roller 23 includes a first driving roller 23*a* that is driven by a motor (not shown in the drawings), and a first driven roller 23*b* that is positioned so as to face the first driving roller 23*a* with the roll-shaped medium 2 interposed therebetween. In the same manner, the second transport roller 24 includes a second driving roller 24*a* that is driven by a motor (not shown in the drawings), and a second driven roller 24*b* that is positioned so as to face the second driving roller 24*a* with the roll-shaped medium 2 interposed therebetween. Additionally, in the present embodiment, an auxiliary member 34 that assists with transport of the roll-shaped medium 2 is provided between the relay roller 19 and the first transport roller 23.

The winding unit 25 is a unit that winds the roll-shaped medium 2 (roll-shaped medium 2 upon which image recording has been completed) that is delivered by the transport unit 20. As shown in FIG. 1, the winding unit 25 includes a relay roller 26 for transporting the roll-shaped medium 2, which is delivered from the second transport roller 24, from an upstream side in the transport direction toward the downstream side in the transport direction with the roll-shaped medium 2 suspended on the relay roller 26, and a roll-shaped medium winding driving shaft 27, which is rotatably supported, and which winds the roll-shaped medium 2 that is delivered from the relay roller 26. Additionally, in the present embodiment, the support portion 35, which supports the roll-shaped medium 2, is provided between the second transport roller 24 and the relay roller 26.

The discharge unit 30 is capable of discharging a liquid, and in the present embodiment, is a unit that records (prints) an image on the roll-shaped medium 2 that is positioned in an image recording region on the transport pathway. More specifically, a platen 33 is disposed in a position that faces the discharge unit 30, and as shown in FIG. 1, the discharge unit 30 forms an image on the roll-shaped medium 2, which is sent onto the platen 33 by the transport unit 20, by discharging ink, as an example of a liquid.

For example, the discharge unit 30 is an ink jet head, and a piezo element (not shown in the drawings) is provided in the discharge unit 30 as a driving element for discharging ink droplets. When a voltage of is applied between electrodes that are provided at both ends of the piezo element for a predetermined duration, the piezo element expands depending on the application time of the voltage, and deforms a side wall of an ink flow channel. As a result of this, a volume of the ink flow channel contracts according to the expansion and the piezo element, and an amount of ink that corresponds to the contraction is discharged as ink droplets.

The heating unit 40 is a unit that heats the roll-shaped medium 2 on which ink has been applied by the discharge unit 30. In other words, the heating unit 40 is a unit for curing ink by applying heat to ink that is on the roll-shaped medium 2. For example, the heating unit 40 is an infrared heater that radiates infrared rays, and applies heat in a heat application range. In addition, as shown in FIG. 1, the heating unit 40 is provided to face the support portion 35. That is, the heating unit 40 applies heat to the roll-shaped medium 2 that is supported by the support portion 35.

The detection unit 72 is a unit that detects an energy that is emitted from a detection range as a result of the heating of the heating unit 40. For example, the detection unit 72 is an infrared sensor. Further, the detection unit 72 detects an energy of infrared rays by sensing a surface of the roll-shaped medium 2 that is within the heat application range of the heating unit 40 (or in other words, an irradiation range of infrared rays of the heating unit 40).

The cutter 50 is a component for cutting the roll-shaped medium 2. In addition to a mode in which the roll-shaped medium 2 upon which an image has been formed by the discharge unit 30 as mentioned above, is wound by the winding unit 25, the liquid discharging apparatus 1 of the present embodiment is provided with a mode (a non-winding mode) in which a portion of the roll-shaped medium 2 on which an image has been formed, is cut away from the roll-shaped medium 2 without winding the roll-shaped medium 2 upon which an image has been formed, as a result of ink being applied onto the roll-shaped medium 2 by the discharge unit 30 and drying the applied ink using the heating unit 40, and in a case in which the non-winding mode is selected, the roll-shaped medium 2 is cut to a predetermined size by the cutter 50, and the roll-shaped medium 2 on which image recording has been completed is cut away from the roll-shaped medium 2 on which image recording is yet to be performed. As shown in FIG. 1, the cutter 50 is provided between the discharge unit 30 and the heating unit 40 in the transport direction. Additionally, media that is cut by the non-winding mode is ejected while sliding down the support portion 35.

Figure 2:
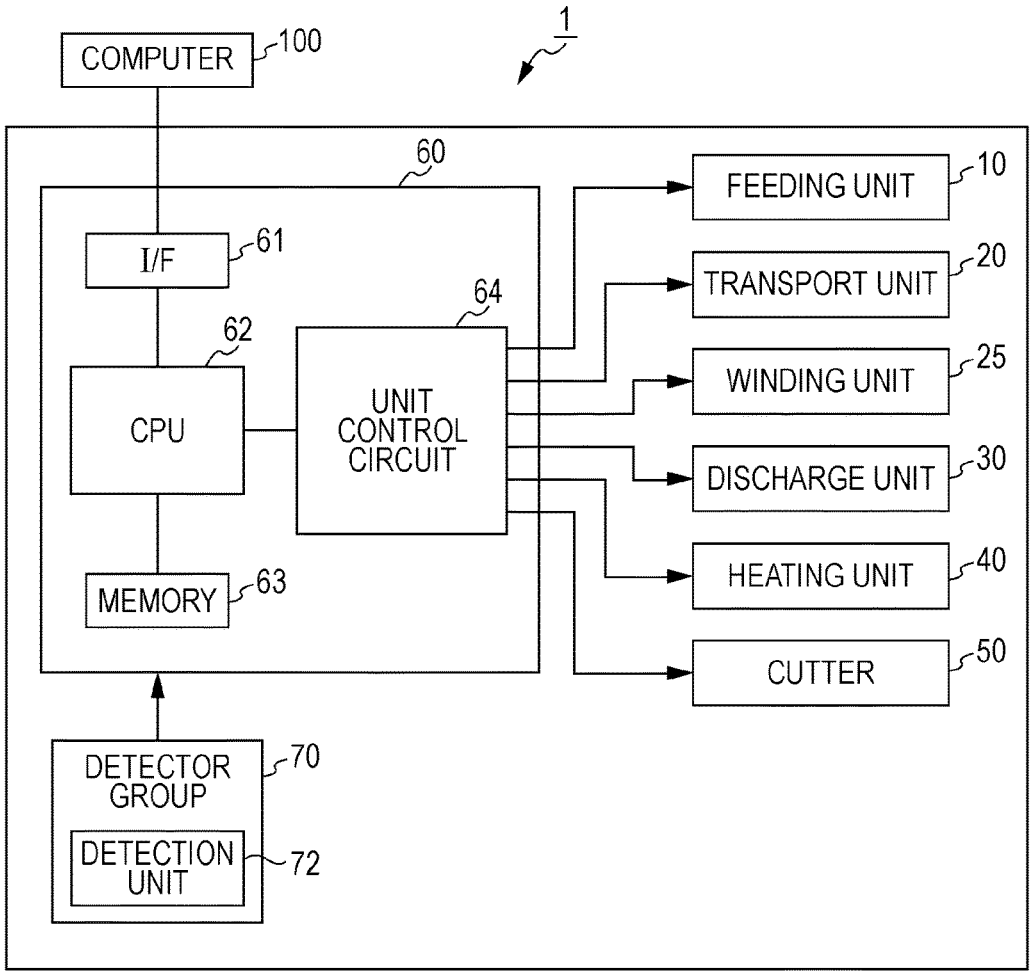
FIG. 2 is a block diagram that shows a configuration of the control unit of the liquid discharging apparatus.

Next, a configuration of the control unit of the liquid discharging apparatus will be described. FIG. 2 is a block diagram that shows a configuration of the control unit of the liquid discharging apparatus. As shown in FIG. 2, the liquid discharging apparatus 1 is provided with the control unit 60. The control unit 60 performs control of the liquid discharging apparatus 1. The control unit 60 includes an interface unit 61, a CPU 62, a memory 63 and a unit control circuit 64. The interface unit 61 performs the transmission and reception of data between a computer 100, which is an external apparatus, and the liquid discharging apparatus 1. The CPU 62 is an arithmetic operation device for performing control of the entire liquid discharging apparatus 1. The memory 63 is a component for securing regions that store the programs of the CPU 62, work regions and the like, and includes a storage element such as RAM, which is volatile memory, EEPROM, which is non-volatile memory or the like.

The feeding unit 10, the transport unit 20, the winding unit 25, the discharge unit 30, the heating unit 40 and the cutter 50 are electrically connected to the unit control circuit 64, and the liquid discharging apparatus 1 that has received printing instructions (printing data) from the computer 100 controls each unit through the unit control circuit 64 according to the programs that are stored in the memory 63 using the control unit 60.

In addition, the inside of the liquid discharging apparatus 1 is monitored by a detector group 70 including various detectors, and the detector group 70 outputs a detection result to the control unit 60. The control unit 60 controls each unit on the basis of the detection result that is output from the detector group 70. Additionally, a detection unit 72 is included in the detector group 70. Further, the detection unit 72 detects an energy that is emitted from a detection range as a result of the heating of the heating unit 40, and the control unit 60 can change an output of the heating unit 40 on the basis of the detected energy. For example, the detection unit 72 senses a surface of the roll-shaped medium 2 that is within the heat application range of the heating unit 40. Further, the control unit 60 controls an irradiation energy of the heating unit 40 on the basis of an energy of infrared rays that is detected by the detection unit 72.

Hereinafter, a method that performs the detection of energy suitably irrespective of the presence or absence of the roll-shaped medium 2 in the detection range of the detection unit 72, will be described. As described above, the liquid discharging apparatus 1 according to the present embodiment is driven with the winding mode or the non-winding mode. For example, when the non-winding mode is executed, the roll-shaped medium 2 is positioned or not on the support portion 35. Further, when the roll-shaped medium 2 is not positioned on the support portion 35, since the roll-shaped medium 2 is not at a sensing target of the detection unit 72, the detection unit 72 senses the surface of the support portion 35 instead of the surface of the roll-shaped medium 2. That is, the surface of the support portion 35 is sensed by the detection unit 72, and the control of the irradiation energy of the heating unit 40 is performed on the basis of a sensing result. In other words, there are cases in which the detection unit 72 senses the support portion 35, and there are cases in which the detection unit 72 senses the roll-shaped medium 2 that is supported by the support portion 35.

Further, in such a state (a state in which the roll-shaped medium 2 is not at the sensing target. Referred to as a second state), since a status of a sensing target differs from when the surface of the roll-shaped medium 2 is sensed (for example, a difference between paper and metal), the same irradiation energy control (irradiation energy control as when sensing the surface of the roll-shaped medium 2) as when the roll-shaped medium 2 is at the sensing target (referred to as a first state) is not possible. Therefore, there is a concern that the irradiation energy will not be an irradiation energy that will set the roll-shaped medium 2 to a predetermined temperature (a sufficient irradiation energy) when the roll-shaped medium 2 is positioned on the support portion 35 from the second state (or in other words, when the roll-shaped medium 2 reaches the support portion 35). In such an instance, in the present embodiment, a sensing target portion 36 is provided so that, even in a state in which the roll-shaped medium 2 is not at the sensing target, irradiation energy control can also be executed in the same manner as when the roll-shaped medium 2 is at the sensing target. Hereinafter, a configuration of the sensing target portion will be described.

Figure 3:
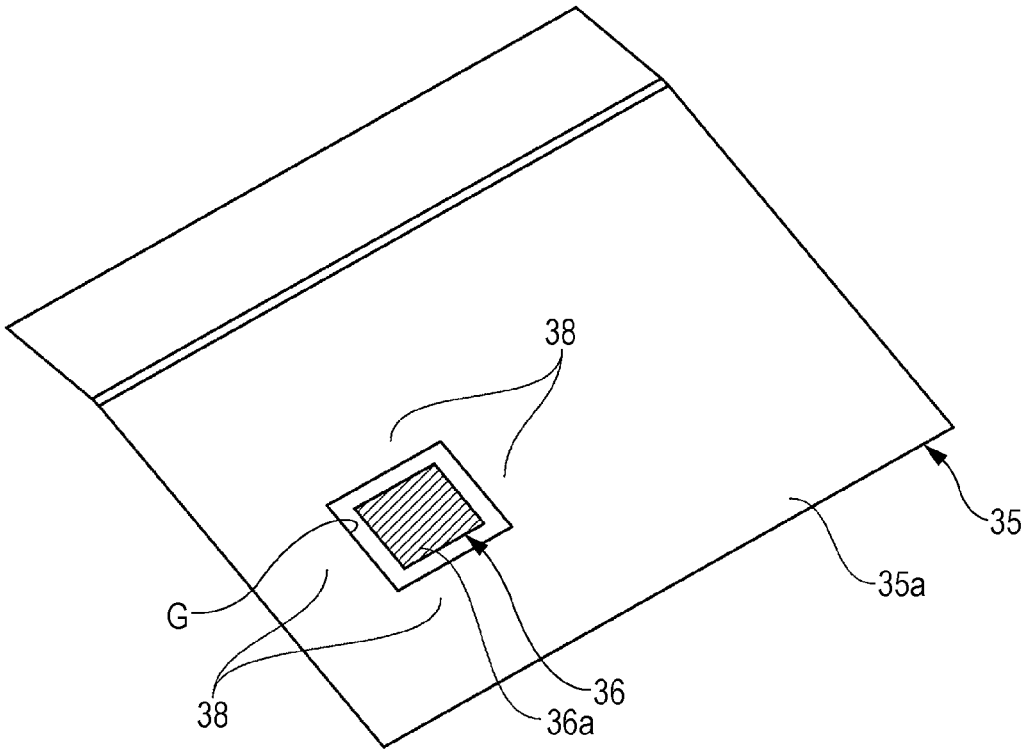
FIG. 3 is a perspective view that shows a configuration of a sensing target portion.
Figure 4:
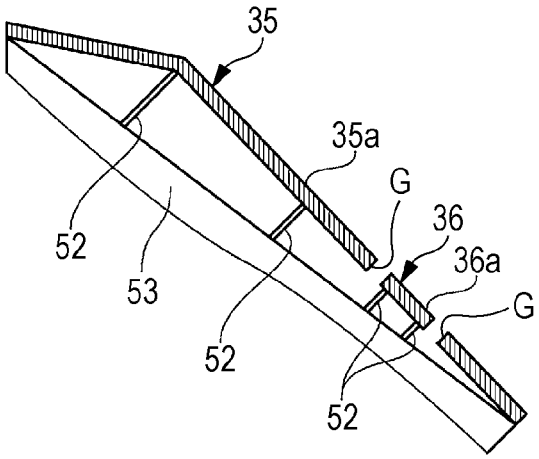
FIG. 4 is a lateral cross-sectional view that shows a configuration of the sensing target portion.

FIG. 3 is a perspective view that shows a configuration of the sensing target portion 36, and FIG. 4 is a lateral cross-sectional view that shows a configuration of the sensing target portion 36. The sensing target portion 36 is provided with a sensing target surface 36*a* from which an energy is detected by the detection unit 72. As shown in FIGS. 3 and 4, in the present embodiment, the sensing target portion 36 is disposed in a portion of a disposition region of the support portion 35. At this time, the sensing target portion 36 is disposed so that at least a portion of the sensing target portion 36 is disposed in the detection range of the detection unit 72. In addition, in the support portion 35, the sensing target portion 36 (the sensing target surface 36*a* in the present embodiment) is provided on the same surface as a support surface 35*a* that is capable of supporting the roll-shaped medium 2. However, the sensing target portion 36 (the sensing target surface 36*a* in the present embodiment) may be provided in a position that is lower than the support surface 35*a*. That is, the sensing target portion 36 is configured so that the roll-shaped medium 2 passes over the sensing target portion 36 (the sensing target surface 36*a*). As a result of this, it is possible to perform transport of the roll-shaped medium 2 smoothly with the target sensing unit 36 not obstructing the transport of the roll-shaped medium 2. Further, the detection unit 72 detects an energy from the roll-shaped medium 2 when the roll-shaped medium 2 is in the detection range, and detects an energy from the sensing target portion 36 when the roll-shaped medium 2 is not in the detection range. In addition, the sensing target portion 36 is made of metal.

Further, in the present embodiment, in order to execute irradiation energy control as when the roll-shaped medium 2 is at the sensing target even in a state in which the roll-shaped medium 2 is not at the sensing target, matching of the characteristics of the sensing target portion 36 that are sensed by the detection unit 72 in a state in which the roll-shaped medium 2 is not at the sensing target to the characteristics of the roll-shaped medium 2 is performed.

Firstly, matching of a heat capacity of the sensing target portion 36 to a heat capacity of the roll-shaped medium 2 is performed. More specifically, a volume of the sensing target portion 36 (the volume of a shaded section in FIG. 3) is set so that a heat capacity of the roll-shaped medium 2 which is in the heat application range of the heating unit 40 (refer to FIG. 1) becomes equivalent to a heat capacity of the sensing target portion 36 (the shaded section in FIG. 3). Additionally, the heat capacity is calculated using the product of specific heat and mass. In addition, the mass is calculated using the product of density and volume. Further, since the metal sensing target portion 36 has higher heat capacity per unit volume than the roll-shaped medium 2, the volume of the metal sensing target portion 36 is set to be as small as possible.

More specifically, as shown in FIG. 3, a gap G is provided between the sensing target portion 36 and a sensing target portion peripheral section 38 (a portion of the support portion 35) that is positioned around the sensing target portion 36. That is, in order to reduce the volume of the sensing target portion 36, the sensing target portion 36 is made into a small island shape, and is configured so that the sensing target portion 36 is isolated from the sensing target portion peripheral section 38.

Furthermore, as shown in FIG. 4, in order to make the sensing target portion 36 thin, the sensing target portion 36 is made as a thin plate (a thin plate with a thickness of 0.5 mm in the present embodiment), and a propping section 52 that props up the thin plate of the sensing target portion, is provided. In addition, the support portion 35 is also configured as a thin plate in the same manner, and is connected to the propping section 52. Further, the propping section 52 is installed on a propping base 53. As a result of this, the sensing target portion 36 is made thin while realizing a configuration in which the support portion 35 is firmly supported.

In addition, matching of the radiation rate of the sensing target portion 36 to the radiation rate of the roll-shaped medium 2 is performed. As shown in FIG. 7, while the radiation rate of the main medium that is used as the roll-shaped medium 2, is measured by emission rate measurement equipment, the radiation rate of the medium is a range of approximately 0.8 to approximately 0.95. Therefore, the radiation rate of the sensing target portion 36 is set to greater than or equal to 0.7 and 1 or less. If this configuration is set, a difference (a radiation rate difference) between the radiation rate of the sensing target portion 36 and the radiation rate of the roll-shaped medium 2 becomes within 0.1. If the radiation rate difference is within 0.1, the radiation rate difference corresponds to within approximately three degree in a case in which the radiation rate difference is converted into a temperature difference, and it is understood to be a level at which there is not a problem in terms of temperature control.

Therefore, if the radiation rate of the sensing target portion 36 is set to greater than or equal to 0.7 and 1 or less, it is possible to suitably perform control of the heating unit 40 with respect to media such as acrylic resin, PET resin, vinyl chloride resin, fabric and paper, which are included as examples in the present embodiment. In addition, if the radiation rate of the sensing target portion 36 is set to greater than or equal to 0.85 and less than or equal to 0.95, it is possible to further reduce a radiation rate difference with respect to media such as PET resin, vinyl chloride resin, fabric and paper, which are included as examples in the present embodiment. Therefore, if the radiation rate of the sensing target portion 36 is set to greater than or equal to 0.85 and less than or equal to 0.95, it is possible to more suitably perform control of the heating unit 40 with respect to a portion of media. In addition, if the radiation rate of the sensing target portion 36 is set to 0.9, it is possible to further reduce a radiation rate difference with respect to the medium of vinyl chloride resin, which is included as an example in the present embodiment. Therefore, if the radiation rate of the sensing target portion 36 is set to 0.9, it is possible to more suitably perform control of the heating unit 40 with respect to a portion of media.

Furthermore, in the present embodiment, the sensing target surface 36*a* is processed in order to reduce mirror reflection of light that is input from the heating unit 40. The reason for this is that, in the detection unit 72, if detection is performed including a reflected component in which light that is input from the heating unit 40 has been mirror reflected by the sensing target surface 36*a* when an energy that is emitted from the sensing target surface of the sensing target portion 36 is detected, noise is included in an original detected value. For example, in a case in which the heating unit 40 is an infrared heater, and the detection unit 72 is an infrared sensor, a reflected component of infrared rays that are radiated from the heating unit 40 becomes noise in the detection unit 72. In addition, the processing is a processing not only for reducing mirror reflection of light that is input from the heating unit 40 but also for reducing mirror reflection of light that is input to the sensing target portion 36. In other words, a light source of light that is input to the sensing target portion 36 is not limited to the heating unit 40.

In the present embodiment, at least a portion of the sensing target surface 36*a* is surface processed. More specifically, the sensing target portion 36 is formed using aluminum, and alumite processing is performed on at least a portion of the sensing target surface 36*a*. As a result of this, it is possible to reduce a mirror reflection component due to dispersion and absorption when light that is input from the heating unit 40 is reflected by the sensing target surface on which alumite processing has been performed. In addition, as a result of the alumite processing, it is possible to raise the radiation rate of the aluminum that is used in the sensing target portion 36 (approximately 0.1) to approximately 0.9, and therefore, it is possible to match the radiation rate of the roll-shaped medium 2.

According to the abovementioned embodiment, it is possible to obtain the following effects.

The sensing target portion 36 is disposed in a portion of the disposition position of the support portion 35. As a result of this, even in a case in which the roll-shaped medium 2 is not in a sensing area of the detection unit 72 (detection range), it is possible to detect an energy that is emitted from the sensing target surface 36*a* of the sensing target portion 36.

Therefore, it is possible to perform the detection of energy irrespective of the presence or absence of the roll-shaped medium 2 in the sensing area of the detection unit 72. As a result of this, it is possible to suitably perform output control of the heating unit 40. Furthermore, since alumite processing is carried out on the sensing target surface 36*a*, a mirror reflection component is reduced when light that is input from the heating unit 40 is reflected by the sensing target surface 36*a*. In addition, a mirror reflection component is even reduced when light that is input from any light source is reflected by the sensing target surface 36*a*. As a result of this, it is possible to perform output control of the heating unit 40 with further precision.

Additionally, the invention is not limited to the abovementioned embodiment, and it is possible to add various modifications and improvements and the like to the embodiment that is described above. Modification examples will be described below.

Modification Example 1

In the abovementioned embodiment, the alumite processing is carried out on the sensing target surface 36*a* as the surface processing, but the surface processing is not limited to this. For example, a plating process (for example, black plating) may be carried out on the sensing target surface 36*a*, or various coatings of the sensing target surface 36*a* may be carried out. In addition, for example, an absorptive layer that includes silicon may be configured on the sensing target surface 36*a*.

Even if the sensing target surface 36*a* is configured in this manner, it is possible to reduce a mirror reflection component in the same manner as the abovementioned effects.

Modification Example 2

Figure 5A:
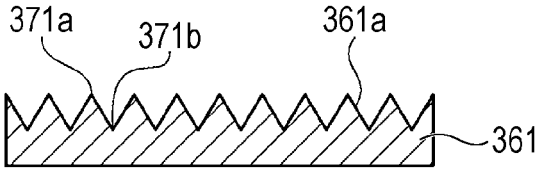
FIGS. 5A to 5E are lateral cross-sectional views that show configurations of sensing target portions according to modification examples.
Figure 5B:
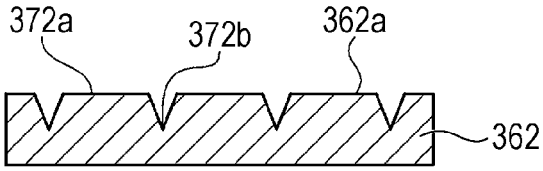
Figure 5C:
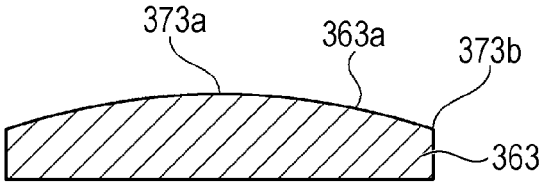
Figure 5D:
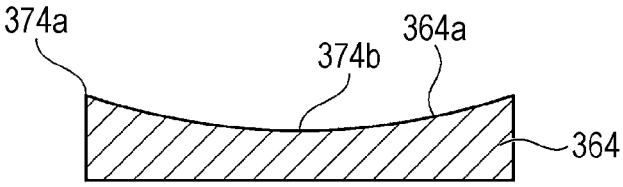
Figure 5E:
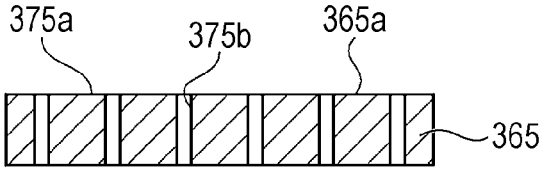

In the abovementioned embodiment, surface processing is carried out on the sensing target surface 36*a*, but the invention is not limited to this configuration. For example, the sensing target surface is processed so as to have first portions, and second portions that are lower than the first portions. FIGS. 5A to 5E are lateral cross-sectional views that show configurations of sensing target portions according to modification examples. As shown in FIG. 5A, a sensing target surface 361*a* of a sensing target portion 361 includes first portions 371*a*, and second portions 371*b* that are lower than the first portions 371*a*, and the sensing target surface 361*a* has an uneven shape. In addition, as shown in FIG. 5B, a sensing target surface 362*a* of a sensing target portion 362 includes first portions 372*a*, and second portions 372*b* (target penetration slits) that are lower than the first portions 372*a*, and the sensing target surface 362*a* has an uneven shape that includes level surfaces. In addition, as shown in FIG. 5C, a sensing target surface 363*a* of a sensing target portion 363 includes first portions 373*a*, and second portions 373*b* that are lower than the first portions 373*a*, and the sensing target surface 363*a* has a convex shape in a cross-sectional view. In addition, as shown in FIG. 5D, a sensing target surface 364*a* of a sensing target portion 364 includes first portions 374*a*, and second portions 374*b* that are lower than the first portions 374*a*, and the sensing target surface 364*a* has a concave shape in a cross-sectional view. In addition, as shown in FIG. 5E, a sensing target surface 365*a* of a sensing target portion 365 includes first portions 375*a*, and penetration holes 375*b* as second portions that are lower than the first portions 375*a*. Additionally, in addition to the configurations mentioned above, a sensing target portion in which an embossing treatment is performed on the sensing target surface, a lacquered sensing target portion, and a sensing target portion in which penetration slits are formed are also possible. Even if the sensing target surface 36*a* is configured in this manner, light that is input from the heating unit 40, is dispersed (scattered) by the first portions 371*a* to 375*a*, and the second portions 371*b* to 375*b* when the light is reflected by the sensing target surfaces 361*a* to 365*a*.

Modification Example 3

In the abovementioned embodiment, the support portion 35 was described as a thin plate, but is not limited to this configuration. For example, the support portion 35 may be configured in a mesh shape (a net shape) by linear members. If such a configuration is set, when the ink coated on the roll-shaped medium 2 is heated by the heating unit 40, it is possible for vapor from the evaporation of ink to be let out to the outside through the meshing of the support portion 35, and therefore, it is possible to control the generation of condensation on the support portion 35.

Modification Example 4

Figure 6:
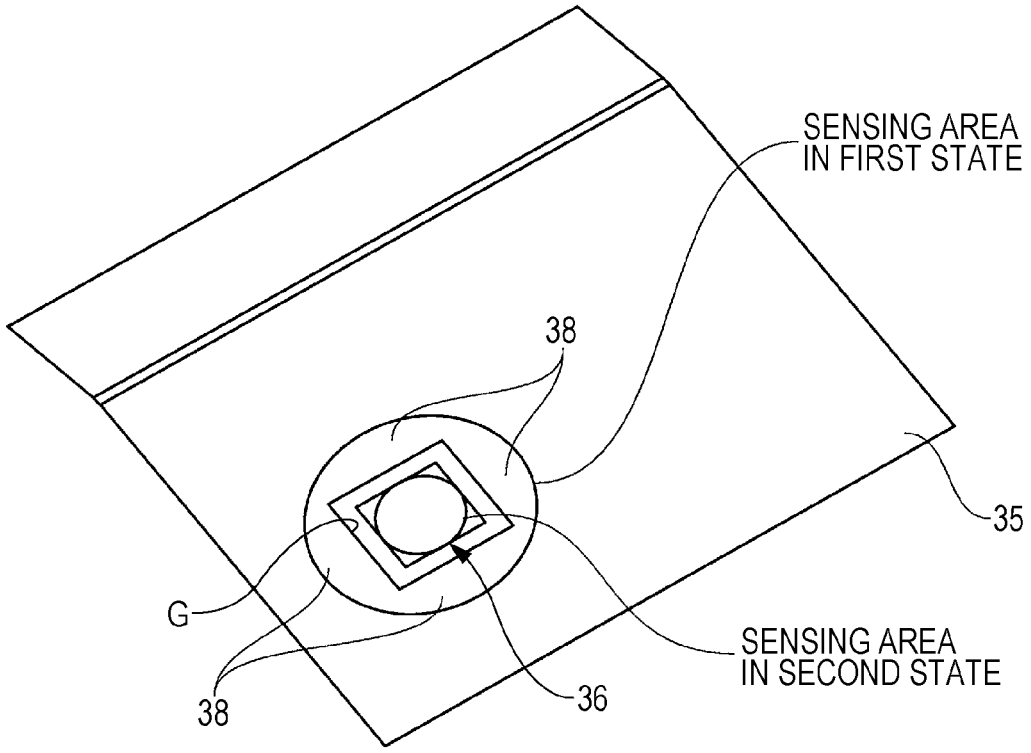
FIG. 6 is an explanatory diagram that describes a width of a sensing area according to a modification example.

A configuration in which the width of the sensing area that the detection unit 72 senses is changeable, and in which the width of the sensing area changes between a first state in which the roll-shaped medium 2 is at the sensing target, and a second state in which the roll-shaped medium 2 is not at the sensing target, may be used. In other words, the width (size) of the sensing area changes between a case in which the detection unit 72 senses the sensing target portion 36, and in a case in which the detection unit 72 senses the roll-shaped medium 2 that is supported on the support portion 35. FIG. 6 is an explanatory diagram that describes a width of a sensing area according to a modification example. As shown in FIG. 6, a sensor in which it is possible to change the width of a sensing area thereof is prepared as the detection unit 72, and in the second state in which the sensing target portion 36 is sensed, the control unit 60 controls the width of the sensing area so that the sensing area is restricted to within the sensing target portion 36. For example, in a case in which the sensing area is wider than the sensing target portion 36 when switching to the second state, the sensing area is made more narrow (smaller). On the other hand, in the first state in which the surface of the roll-shaped medium 2 is sensed, since it is not necessary to restrict the sensing area to within the sensing target portion 36, the sensing area is made wider than the width of the second state (or preferably, a maximum width) in order to improve the uniformity of sensing results by causing the detection unit 72 to sense over a wide range. If such a configuration is set, since it is possible to suitably exhibit the capacity of the sensor that is used as the detection unit 72, it is possible to realize more suitable control of the heating unit 40.

Modification Example 5

In the abovementioned embodiment, the liquid discharging apparatus was embodied as an ink jet type printer, but a liquid discharging apparatus that ejects or discharges a liquid other than ink can be adopted, and it is possible to adopt the invention in various liquid ejecting apparatuses that are provided with liquid discharge heads that discharge minute amounts of liquid droplets or the like. Additionally, liquid droplets refer to the state of liquid that is discharged from the abovementioned liquid discharging apparatuses, and may include droplets that leave a trail in a granular form, a tear form or a string form. In addition, the liquid that is referred to in this instance may be any material that a liquid discharging apparatus can eject. For example, the liquid may be any substance that is in a state in which it is in the liquid phase, and may include liquids in which particles of functional material that are formed from solid matter such as pigments or metal particles are dissolved, dispersed, or mixed into a solvent in addition to liquid states with high or low viscosities, fluid states such as sols, gel waters, other inorganic solvents, organic solvents, solutions, liquid resins, liquid metals (metallic melts) or liquid in a state of substances. In addition, an ink, liquid crystal or the like such as that described in the abovementioned embodiment can be given as a representative example of the liquid. In this instance, ink can include various liquid compositions such as a general water-based ink or oil-based ink, a gel ink, or a hot melt ink. As specific examples of a liquid discharging apparatuses, for example, it is possible to use liquid discharging apparatuses that discharge liquids that include materials such as electrode materials and color materials, which are used in the manufacturing of liquid crystal displays, EL (electroluminescence) displays, surface-emitting displays, color filters and the like in a dispersed or dissolved form, liquid discharging apparatuses that discharge living organic material that is used in the manufacture of biochips, or liquid discharging apparatuses, that discharge liquids that form specimens that are used as precision pipettes, printing equipment, microdispensers or the like. Furthermore, it is possible to adopt a liquid discharging apparatus that discharges a lubricating oil with pinpoint precision in a precision instrument such as a watch or a camera, a liquid discharging apparatus that discharges a transparent resin liquid such as an ultraviolet curable resin for forming a microhemispherical lens (an optical lens) or the like that is used in optical communication elements or the like onto a substrate, or a liquid discharging apparatus that discharges an etching liquid such as an acid or an alkali for etching a substrate or the like. Further, it is possible to adopt the invention in any one of these various ejecting apparatuses.

In addition, the ink of the present embodiment may include a resin emulsion. A resin emulsion exhibits an effect that causes favorable abrasion resistance in an image by sufficiently attaching a coloring ink to a target recording medium due to the formation of a resin coating in addition to preferably a wax (an emulsion) when heat is applied to the target recording medium. As a result of the abovementioned effect, recorded objects that are recorded using coloring ink that contains a resin emulsion have superior abrasion resistance on target recording media that do not absorb or are poor absorbers of ink in particular. Although not limited to these, for example, single polymers or copolymers of (meth) acrylic acid, (meth)acrylic acid ester, acrylonitrile, cyanoacrylate, acrylamide, olefin, styrene, vinyl acetate, vinyl chloride, vinyl alcohol, vinyl ether, vinylpyrrolidone, vinyl pyridine, vinylcarbazole, vinyl imidazole and vinylidene chloride, fluorine resins and natural resins can be given as examples of resin emulsions.

Among these, at least either one of a (meth)acrylic resin and a styrene-(meth)acrylic acid copolymer resin is preferable, at least either one of an acrylic resin and a styrene-acrylic acid copolymer resin is more preferable, and a styrene-acrylic acid copolymer resin is still more preferable. Additionally, the abovementioned copolymers may be any form of copolymer including a random copolymer, a block copolymer, an alternating copolymer and a graft copolymer.

Modification Example 6

In the abovementioned embodiment, the transport unit 20 was configured to have the first transport roller 23 that is positioned further on the upstream side in the transport direction than the discharge unit 30, and the second transport roller 24 that is positioned further on the downstream side in the transport direction than the discharge unit 30, but the number of transport rollers and the arrangement thereof is not limited to this configuration, and it is possible to set the number of transport rollers and the arrangement thereof as appropriate.

Modification Example 7

In the abovementioned embodiment, an example that used the roll-shaped medium 2 as an example of the medium was given, but the medium may be cut form medium. In a case in which the medium is cut form medium, there is a high probability that a state in which the medium is not positioned on the support portion 35 will occur at the start of recording. However, it is also desirable that the radiation energy of the heating unit 40 is already a radiation energy (a suitable radiation energy) that sets the medium to a predetermined temperature at the start of recording. If the invention is used, it is possible to suitably perform control of the heating unit 40 even in a case in which the medium is cut form media.

Modification Example 8

In the abovementioned embodiment, an example in which an infrared sensor is used as the detection unit 72 is given, but other sensors may be used in the detection unit 72. As long as the sensor detects electromagnetic waves that are emitted from the surface of a medium, sensors that detect ultraviolet rays, microwaves or the like may be used. Among these, with the aim of estimating the temperature of the medium, the use of an infrared sensor is more effective. Additionally, infrared rays refer to electromagnetic waves in a wavelength region of approximately 0.7 μm to 1000 μm. Among the wavelength region of approximately 0.7 μm to 1000 μm, the infrared sensor 72 may be a detection unit that detects electromagnetic waves in a wavelength region of at least a portion thereof.

The entire disclosure of Japanese Patent Application No. 2014-115509, filed Jun. 4, 2014 is expressly incorporated reference herein.

What is claimed is:

1. A liquid discharging apparatus comprising:

a discharge unit that is capable of discharging a liquid;

a heating unit that is capable of heating a medium onto which the liquid is discharged;

a detection unit that detects an energy that is emitted from a detection range;

a control unit that is capable of controlling an output of the heating unit on the basis of an energy that the detection unit detects;

a support unit that supports the medium while being heated by the heating unit; and a sensing target portion, which has a sensing target surface from which an energy is detected by the detection unit, wherein the sensing target portion is disposed in an opening defined by a gap in the support unit;

wherein the sensing target surface is processed in order to reduce mirror reflection of input light, and wherein the sensing target portion is selected so that a radiation rate of the sensing target portion is substantially matched with a radiation rate of the medium.

2. The liquid discharging apparatus according to claim 1, wherein the sensing target surface is processed so as to have first portions at a first height relative to the sensing target surface, and second portions that are at a second height that is lower than the first portions.

3. The liquid discharging apparatus according to claim 1, wherein surface processing is carried out on at least a portion of the sensing target surface.

4. The liquid discharging apparatus according to claim 3, wherein at least a portion of the sensing target surface is made of an aluminum on which alumite processing has been performed.

5. The liquid discharging apparatus according to claim 1, wherein a radiation rate of the sensing target portion is greater than or equal to 0.7 and less than 1.

6. The liquid discharging apparatus according to claim 1, further comprising:

a support unit with a support surface that is capable of supporting the medium, wherein the sensing target portion is provided on the same surface as the support surface, or in a position that is lower than the support surface.

7. The liquid discharging apparatus according to claim 1, wherein the detection unit detects an energy from the medium when the medium is in the detection range, and detects an energy from the sensing target portion when the medium is not in the detection range.

8. A heating unit control method comprising:

discharging a liquid;

heating a medium onto which the liquid is discharged with a heating unit;

detecting an energy that is emitted from a detection range; and controlling an output of the heating unit on the basis of the detected energy, wherein the energy is detected from a sensing target surface, which is processed in order to reduce mirror reflection of input light, wherein the sensing target portion is selected so that a radiation rate of the sensing target portion is substantially matched with a radiation rate of the medium, wherein the sensing target surface is disposed in an opening defined by a gap in the support unit.

* * * * *